US008017551B2

(12) United States Patent
Shinohara et al.

(10) Patent No.: US 8,017,551 B2
(45) **Date of Patent: *Sep. 13, 2011**

(54) HEAT-SENSITIVE TRANSFER IMAGE-RECEIVING SHEET

(75) Inventors: Ryuji Shinohara, Minami-ashigara (JP); Yoshihiko Fujie, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 1138 days.

This patent is subject to a terminal disclaimer.

(21) Appl. No.: 11/716,046

(22) Filed: Mar. 9, 2007

(65) Prior Publication Data

US 2007/0213224 A1 Sep. 13, 2007

(30) Foreign Application Priority Data

Mar. 10, 2006 (JP) ..... 2006-065427

(51) Int. Cl.
*B41M 5/035* (2006.01)
*B41M 5/50* (2006.01)

(52) U.S. Cl. ..... 503/227

(58) Field of Classification Search ..... None
See application file for complete search history.

(56) References Cited

U.S. PATENT DOCUMENTS 7,381,685 B2 * 6/2008 Oguma et al. ..... 503/227
7,485,402 B2 * 2/2009 Arai et al. ..... 430/201

FOREIGN PATENT DOCUMENTS

| | | | |
|---|---|---|---|
| JP | 61-283595 | A | 12/1986 |
| JP | 02-000890 | A | 1/1990 |
| JP | 2-89690 | | 3/1990 |
| JP | 02-231192 | A | 9/1990 |
| JP | 02-235792 | A | 9/1990 |
| JP | 9-99651 | | 4/1997 |
| JP | 11-48623 | A | 2/1999 |
| JP | 11-321128 | | 11/1999 |
| JP | 2000-158831 | A | 6/2000 |
| JP | 2000-238440 | A | 9/2000 |
| JP | 2002-192842 | A | 7/2002 |
| JP | 2002-274028 | A | 9/2002 |
| JP | 2004-98604 | A | 4/2004 |
| JP | 2006-062114 | A | 3/2006 |

OTHER PUBLICATIONS

Japanese Office Action corresponding to Japanese Application No. 2006-065427, mailed May 18, 2010 with English Language Translation.

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet, containing, on a support, a receptor layer containing at least one of vinyl chloride polymers, and an intermediate layer containing hollow polymer particles between the support and the receptor layer.

10 Claims, No Drawings

HEAT-SENSITIVE TRANSFER IMAGE-RECEIVING SHEET

FIELD OF THE INVENTION

The present invention relates to a heat-sensitive transfer image-receiving sheet. In particular, the present invention relates to a heat-sensitive transfer image-receiving sheet which gives a high transfer density, reduced image defects, and especially no defect of transferred dye.

BACKGROUND OF THE INVENTION

Various heat transfer recording methods have been known so far. Among these methods, dye diffusion transfer recording systems attract attention as a process that can produce a color hard copy having an image quality closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In an image-receiving sheet on this system, a receptor layer for fixation of dyes transferred to the sheet is formed on a support, and besides, a layer having high cushion properties, such as a foam layer made up of a resin and a foaming agent or a porous layer containing hollow polymer particles, is generally formed between the support and the receptor layer with the intention of enhancing adhesion of the image-receiving sheet to a transfer sheet (see, e.g., JP-A-11-321128 ("JP-A" means unexamined published Japanese patent application) and JP-A-2-89690).

The intermediate layer containing hollow polymer particles is known to be an effective medium for ensuring a high transfer density because of its heat insulating effect. On the other hand, the use of such an intermediate layer as to contain hollow polymer particles causes a problem of aggravating smoothness of the resulting heat-sensitive transfer image-receiving sheet to result in an increase of defects of transferred dye.

When a symbolic, textual or numeric image is transferred, defects of transferred dye are generally inconspicuous because the proportion of white portions is high. In the cases of pictorial images and images including flatly colored portions, however, defects of transferred dye are conspicuous and become a serious problem.

JP-A-11-321128 discloses the formation of a receptor layer by using a coating solution of resin in an organic solvent after an intermediate layer containing as main components hollow particles and a polymer resistant to an organic solvent is formed on a support by coating and drying. In JP-A-11-321128, however, the receptor layer is not specified, so there arises problems, such as defects of transferred dye.

SUMMARY OF THE INVENTION

The present invention resides in a heat-sensitive transfer image-receiving sheet, comprising, on a support, a receptor layer containing at least one polymer selected from the group consisting of vinyl chloride polymers, and an intermediate layer containing hollow polymer particles between the support and the receptor layer.

Other and further features and advantages of the invention will appear more fully from the following description.

DETAILED DESCRIPTION OF THE INVENTION

According to the present invention, there is provided the following means:

(1) A heat-sensitive transfer image-receiving sheet, comprising, on a support, a receptor layer containing at least one polymer selected from the group consisting of vinyl chloride polymers, and an intermediate layer containing hollow polymer particles between the support and the receptor layer.

(2) The heat-sensitive transfer image-receiving sheet as described in (1), wherein the intermediate layer is free of any resins having poor resistance to an organic solvent except for the hollow polymer particles.

(3) The heat-sensitive transfer image-receiving sheet as described in (1) or (2), wherein the intermediate layer further contains a water-soluble polymer.

(4) The heat-sensitive transfer image-receiving sheet as described in any of (1) to (3), wherein the support is a polyethylene-coated paper.

The present invention will be explained in detail below.

The heat-sensitive transfer image-receiving sheet of the present invention is provided with a dye-receiving layer (receptor layer) formed on a support. It is preferable to form an undercoat layer between the receptor layer and the support. As the undercoat layer, for example, a white background control layer, a charge control layer, an adhesive layer and a primer layer may be formed. Also, a heat insulating layer is preferably formed between the undercoat layer and the support. In the present specification, the term "intermediate layer" or "interlayer" means these layers, preferably the heat insulating layer. Moreover, it is preferable that a curling control layer, a writing layer and a charge control layer are formed on the backside of the support. Each layer is applied using a usual method such as a roll coating, a bar coating, a gravure coating and a gravure reverse coating.

[Thermoplastic Polymer]

Examples of the thermoplastic polymer (thermoplastic resin), that may be used in the receptor layer in the present invention include vinyl polymers, such as halogenated polymers (e.g., polyvinyl chloride and polyvinylidene chloride), polyvinyl acetate, ethylene-vinyl acetate copolymer, vinyl chloride-vinyl acetate copolymer, polyacryl ester, polystylene, and polystylene acrylate; acetal polymers, such as polyvinylformal, polyvinylbutyral and polyvinylacetal; polyester polymers, such as polyethylene terephthalate, polybutylene terephthalate and polycaprolactone (e.g., PLACCEL H-5 (trade name) manufactured by DAICEL CHEMICAL INDUSTRIES, LTD.); polycarbonate polymers; cellulose polymers, such as those described in JP-A-4-296595 and JP-A-2002-264543; cellulose polymers, such as cellulose acetate butyrate (e.g., CAB551-0.2 and CAB321-0.1 (each trade name) manufactured by Eastman Chemical Company); polyolefin polymers, such as polypropylene; and polyamide polymers, such as urea resins, melamine resins and benzoguanamine resins. These polymers may be used optionally blending with each other in the range of compatibility. Polymers used for forming the receptor layer are also disclosed in JP-A-57-169370, JP-A-57-207250 and JP-A-60-25793.

In the present invention, the receptor layer contains at least one of vinyl chloride polymers, and it is preferable that the at least one of vinyl chloride polymers is used in combination with polycarbonates, polyesters, polyurethanes and a copolymer thereof, styrene-acrylonitrile copolymers, polycaprolactones, or a mixture of any two or more of the (co)polymers recited above, and it is also allowable to additionally use polycarbonates, polyesters and a copolymer thereof, or a mixture of these (co)polymers.

In addition, the vinyl chloride polymers can be used alone or as a mixture thereof.

(Vinyl Chloride Polymers)

The vinyl chloride polymers, particularly a copolymer using vinyl chloride, used in the receptor layer are explained in more detail.

The vinyl chloride copolymer is preferably one having a vinyl chloride constituent content of 85 to 97% by mass and a polymerization degree of 200 to 800. A monomer forming such a copolymer together with vinyl chloride has no particular restrictions, but any monomer may be used as far as it can be copolymerized with vinyl chloride. However, it is particularly preferably vinyl acetate. Accordingly, the vinyl chloride polymers used in the receptor layer are advantageously a vinyl chloride-vinyl acetate copolymer. However, the vinyl chloride-vinyl acetate copolymer is not necessarily constituted of vinyl chloride and vinyl acetate alone, and may include vinyl alcohol and maleic acid constituents. Examples of other monomer constituents of such a copolymer constituted mainly of vinyl chloride and vinyl acetate include vinyl alcohol and its derivatives, such as vinyl alcohol and vinyl propionate; acrylic or methacrylic acids and their derivatives, such as acrylic acid and methacrylic acid, and their methyl, ethyl, propyl, butyl and 2-ethylhexyl esters; maleic acid, and its derivatives, such as maleic acid, diethyl maleate, dibutyl maleate and dioctyl maleate; vinyl ether derivatives, such as methyl vinyl ether, butyl vinyl ether and 2-ethylhexyl vinyl ether; acrylonitrile and methacrylonitrile; and styrene. The ratio of each of the vinyl chloride and vinyl acetate components in the copolymer may be any ratio, but it is preferable that the ratio of the vinyl chloride component is 50 mass % or more of the copolymer. In addition, it is preferable that the ratio of the above-recited constituents other than the vinyl chloride and vinyl acetate is 10 mass % or less of the copolymer.

Examples of such a vinyl chloride-vinyl acetate copolymer include SOLBIN C, SOLBIN CL, SOLBIN CH, SOLBIN CN, SOLBIN C5, SOLBIN M, SOLBIN MF, SOLBIN A, SOLBIN AL, SOLBIN TA5R, SOLBIN TAO, SOLBIN MK6, and SOLBIN TA2 (trade names, manufactured by Nissin Chemical Industry Co., Ltd.); S-LEC A, S-LEC C and S-LEC M (trade names, manufactured by Sekisui Chemical Co., Ltd.); Vinylite VAGH, Vinylite VYHH, Vinylite VMCH, Vinylite VYHD, Vinylite VYLF, Vinylite VYNS, Vinylite VMCC, Vinylite YMCA, Vinylite VAGD, Vinylite VERR and Vinylite VROH (trade names, manufactured by Union Carbide Corporation); and DENKA VINYL 1000GKT, DENKA VINYL 1000L, DENKA VINYL 1000CK, DENKA VINYL 1000A, DENKA VINYL 1000LK$_2$, DENKA VINYL 1000AS, DENKA VINYL 1000MT$_2$, DENKA VINYL 1000CSK, DENKA VINYL 1000CS, DENKA VINYL 1000GK, DENKA VINYL 1000GSK, DENKA VINYL 1000GS, DENKA VINYL 1000LT$_3$, DENKA VINYL 1000D and DENKA VINYL 1000W (trade names, manufactured by Denki Kagaku Kogyo Kabushiki Kaisha).

[Plasticizer]

For the purpose of enhancing the sensitivity of the receptor layer, a plasticizer (high boiling organic solvent) may also be added. Examples of such a plasticizer include compounds generally used as plasticizers for vinyl chloride resins, and more specifically monomeric plasticizers such as phthalates, phosphates, adipates and sebacates, and polyester-type plasticizers produced by polymerization of adipic acid or sebacic acid and polyethylene glycol. Although the former plasticizers are generally low in molecular weight, olefin-type special copolymer resins that are polymeric plasticizer usable for vinyl chloride resins may be also used. Examples of resins usable for such a purpose include products marketed under the names of ELVALOY 741, ELVALOY 742, ELVALOY HP443, ELVALOY HP553, ELVALOY EP4015, ELVALOY EP4043 and ELVALOY EP4051 (trade names, manufactured by DuPont-Mitsui Polychemicals Co., Ltd.). Such plasticizers can be added to the resins in a proportion of about 100% by mass, but it is appropriate to use them in a proportion of 30% by mass or below in view of bleeding of prints. When a polymer latex is used, it is preferable that those plasticizers are used in a state of the emulsified dispersion.

The receptor layer can be cast by extrusion coating of a fused matter of the polymer resin as recited above without resorting to solvent coating. The techniques of this extrusion coating are described in Encyclopedia of Polymer Science and Engineering, vol. 3, p. 563, John Wiley, New York (1985), and supra, vol. 6, p. 608 (1986). In addition, the technique for heat-sensitive dye transfer materials is disclosed in JP-A-7-179075, and it is also applicable to the present invention. As the polymer resin, copolymer obtained by condensing cyclohexane dicarboxylate and a 50:50 by mole % mixture of ethylene glycol and bisphenol-A-diethanol (COPOL; registered trade mark) is especially preferred.

[Releasing Agent]

If the image-receiving surface of the heat-sensitive transfer image-receiving sheet lacks a sufficient releasing property, problems of so-called abnormal transfer arises. Examples of the abnormal transfer include a problem that a heat-sensitive transfer sheet and a heat-sensitive transfer image-receiving sheet (image-receiving sheet) mutually weld by heat from a thermal head for the imaging-forming, and thereby a big noise due to peeling arises at the time of peeling; a problem that a dye layer is entirely transferred; and a problem that the receptor layer is peeled from the support. As a method of solving such problems of releasing property, it is known that various kinds of releasing agents (lubricant) are incorporated in the receptor layer and that a releasing layer is additionally disposed on the receptor layer. In the present invention, it is preferable to use a releasing agent in the receptor layer in order to keep more securely the releasing property between the heat-sensitive transfer sheet and the image-receiving sheet at the time of printing images.

As the releasing agent, solid waxes such as polyethylene wax, amide wax and Teflon (registered trade name) powder; silicone oil, phosphate compounds, fluorine-based surfactants, silicone-based surfactants and others including releasing agents known in the technical fields concerned may be used. Among these, fluorine compounds typified by fluorine-based surfactants, silicone-based surfactants and silicone compounds such as silicone oil and/or its hardened products are preferably used.

As the silicone oil, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all Of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into a reaction-curable type, photocurable type and catalyst-curable type. Among these types, silicone oil that is the reaction-curable type is particularly preferable. As the reaction-curable type silicone oil, products obtained by reacting an amino-modified silicone oil with an epoxy-modified silicone oil and then by curing are desirable. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer. The releasing agent is used generally in an amount of 2 to 4% by mass and preferably 2 to 3% by mass based on 100 parts by mass of the polyester resin. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 (trade name, manufactured by Shin-Etsu Chemical Co., Ltd.). Modified silicones represented by any one of the following Formulae 1 to 3 may also be used.

Formula 1

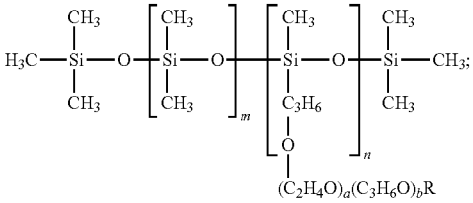

In the Formula 1, R represents a hydrogen atom or a straight-chain or branched alkyl group which may be substituted with an aryl or cycloalkyl group. m and n respectively denote an integer of 2,000 or less, and a and b respectively denote an integer of 30 or less.

Formula 2

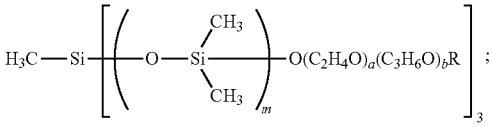

In the Formula 2, R represents a hydrogen atom or a straight-chain or branched alkyl group which may be substituted with an aryl or cycloalkyl group. m denotes an integer of 2,000 or less, and a and b respectively denote an integer of 30 or less.

Formula 3

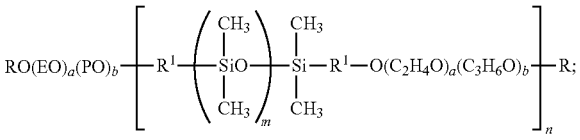

In the Formula 3, R represents a hydrogen atom or a straight-chain or branched alkyl group which may be substituted with an aryl or cycloalkyl group. $R^1$ represents a single bond or a divalent linking group, E represents an ethylene group which may be further substituted, and P represents a propylene group which may be further substituted. m and n each independently denote an integer of 2,000 or less, and a and b each independently denote an integer of 30 or less.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

In some cases, a dye binder is transferred to the receptor layer in a highlight portion of monochrome printing, to cause an irregular transfer. In addition, it is known that an addition polymerization-type silicone generally progresses a hardening reaction in the presence of a catalyst, and that almost all of complexes of transition metal of VIII group, such as Fe and Pt, are effective, as the hardening catalyst include. Among these, a platinum compound has the highest efficiency in general, and a platinum catalyst, which is generally a platinum complex soluble in the silicone oil, is preferably used. Addition amount necessary for the reaction is sufficiently about 1 to 100 ppm.

This platinum catalyst has a strong interaction with an organic compound containing an element such as N, P and S, an ionic compound of heavy metal such as Sn, Pb, Hg, Bi and As, or an organic compound containing a polyvalent bond such as an acetylene group. Therefore, if the above-described compounds (catalyst poison) are used together with the platinum catalyst, the ability of the catalyst to hydrosilylate is lost. Resultantly, the platinum catalyst cannot work as the hardening catalyst. Therefore, a problem arises that the platinum catalyst causes silicone to lack in hardening ability, when used with such a catalyst poison (See "Silicone Handbook" published by Nikkan Kogyo Shunbun shya). As a result, such an addition polymerization-type silicone causing such a hardening failure cannot show a releasability needed, when it is used in the receptor layer. As a hardener reacting with an active hydrogen, it is considered to use an isocyanate compound. However, this isocyanate compound and an organic tin compound working as a catalyst to the isocyanate compound act as a catalyst poison to the platinum catalyst. Therefore, the addition polymerization-type silicone has been never used together with the isocyanate compound in the past. Resultantly, the addition polymerization-type silicone has been never used together with a modified silicone having an active hydrogen, that shows a releasability needed, when hardened with the isocyanate compound.

However, the hardening failure of the addition polymerization-type silicone can be prevented by 1) setting an equivalent amount of the reactive group of the hardener capable of reacting with the active hydrogen, to the reactive group of both the thermoplastic resin and the modified silicone having an active hydrogen, in the range of from 1:1 to 10:1, and 2) setting an addition amount of the platinum catalyst based on the addition polymerization-type silicone in the range of 100 to 10,000 ppm in terms of platinum atom of the platinum catalyst. If the equivalent amount of the reactive group of the hardener capable of reacting with the active hydrogen according to the 1) described above is too small, an amount of silicone having an active hydrogen hardened with an active hydrogen of the thermoplastic resin is so small that an excellent releasability needed cannot be achieved. On the other hand, if the equivalent ratio is too large, a time which is allowed to use an ink in a coating solution for the receptor layer is so short that such the equivalent ratio cannot be substantially applied to the present invention. Beside, if the addition amount of the platinum catalyst according to the 2) described above is too small, activity is lost by the catalyst poison, whereas if the addition amount is too large, a time which is allowed to use an ink in a coating solution for the receptor layer is so short that such the addition amount cannot be substantially applied to the present invention.

The amount of the receptor layer to be applied is preferably 0.5 to 10 g/m$^2$ (solid basis, hereinafter, the amount to be applied in the present specification is a value on solid basis unless otherwise noted).

<Releasing Layer>

In the case where the hardened modified silicone oil is not added to the receptor layer, the silicone oil may be added to a releasing layer formed on the receptor layer. In this case, the receptor layer may be provided using at least one of the above-described thermoplastic resins. Besides, a receptor layer to which silicone is added may be used. The releasing layer contains a hardened modified silicone oil. A kind of the silicone to be used and a method of using the silicone are the same as for use in the receptor layer. Also, in the case where a catalyst or a retardant is used, addition of these additives to the receptor layer may be applied. The releasing layer may be formed using only a silicone, or alternatively a mixture of a silicone and a binder resin having a good compatibility therewith. A thickness of the releasing layer is generally in the range of about 0.001 to about 1 g/m$^2$.

Examples of the fluorine surfactants include Fluorad FC-430 and FC-431 (trade names manufactured by 3M).

<Undercoat Layer>

An undercoat layer is preferably formed between the receptor layer and the support. As the undercoat layer, for example, a white background regulation layer, a charge regulation layer, an adhesive layer or a primer layer is formed. These layers may be formed in the same manner as those described in, for example, each specification of Japanese Patent Nos. 3,585,599 and 2,925,244.

<Heat Insulating Layer>

In the present invention, the heat insulating layer (foam layer) serves to protect a support from heat when a thermal head is used to carry out a transfer operation under heating. Also, because the heat insulating layer has high cushion characteristics, a heat-sensitive transfer image-receiving sheet having high printing sensitivity can be obtained even in the case of using paper as the support.

The heat insulating layer is generally made of a resin and a foaming agent. As the resin for the heat insulating layer, known resins such as a urethane resin, acryl resin, methacryl resin and modified olefin resin or those obtained by blending these resins may be used. Each of these resins is dissolved and/or dispersed in an organic solvent or water and the resultant is applied to form a heat insulating layer. The heat insulating layer coating solution is preferably an aqueous type coating solution having no influence on the foaming agent. As the coating solution, for example, a water-soluble, water-dispersible or SBR latex, emulsions including a urethane emulsion, polyester emulsion, emulsion of vinyl acetate and its copolymer, emulsion of a copolymer of acryl types such as acryl or acrylstyrene, vinyl chloride emulsion, or dispersions of these emulsions may be used. When a microsphere which will be explained later is used as the foaming agent, it is preferable to use an emulsion of vinyl acetate or its copolymer or an emulsion of a copolymer of acryl such as acryl or acrylstyrene.

The glass transition point, softness and filmforming characteristics of these resins can be easily controlled by changing the kind and ratio of the monomer to be copolymerized, and are therefore suitable in the point that desired characteristics are obtained even if a plasticizer and filming adjuvant are not added, that a film is reduced in a change in color when it is stored in various environments after formed, and that it is reduced in material properties with time. Also, among the above resins, the SBR latex is undesirable because it usually has a low glass transition point, tends to cause blocking and tends to be yellowed after the film is formed or while it is stored. The urethane emulsion is undesirable because many urethane emulsions contain solvents such as NMP and DMF and therefore tends to have an adverse influence on a foaming agent. The polyester emulsion or dispersion and the vinyl chloride emulsion are undesirable because they generally have high glass transition points, and cause a deterioration in the foaming characteristics of a microsphere. Though there are those which are soft, they are not used preferably because the softness is imparted by adding a plasticizer.

The foaming characteristics of the foaming agent are largely affected by the hardness of a resin. In order for the foaming agent to foam the resin at a desired expansion ratio, the resin is preferably those having a glass transition point of −30 to 20° C. or a minimum filmforming temperature (MFT) of 20° C. or less. Resins having a too high glass transition point lack in softness and cause a deterioration in the foaming characteristics of the foaming agent. Also, resins having a too low glass transition point give rise to blocking caused by adhesiveness (generated on the foaming layer and on the backside of the support when the support on which the foaming layer has been formed is rolled) and cause defects (for instance, when the image-receiving sheet is cut, the resin of the foaming layer adheres to a cutter blade, which deteriorates outward appearance or allows cutting dimension to be out of order). Also, resins of which the minimum filmforming temperature is too high causes film-forming inferiors during coating and drying, giving rise to disorders such as surface cracks.

Examples of the foaming agent include known foaming agents, for example, decomposition type foaming agents such as dinitropentamethylenetetramine, diazoaminobenzene, azobisisobutyronitrile and azodicarboamide, which are decomposed by heating to generate gases such as oxygen, hydrocarbon gas or nitrogen; and microspheres obtained by encapsulating a low-boiling point liquid such as butane and pentane with a resin such as polyvinylidene chloride or polyacrylonitrile to form a microcapsule. Among these materials, microspheres obtained by encapsulating a low-boiling point liquid such as butane and pentane with a resin such as polyvinylidene chloride or polyacrylonitrile to form a microcapsule are preferably used. These foaming agents are respectively foamed by heating after the foam layer is formed, and the resulting foamed layer has high cushion characteristics and heat insulation characteristics. The amount of the foaming agent is preferably in a range preferably from 0.5 to 100 parts by mass based on 100 parts by mass of the resin used to form the foaming layer. When the amount is too less, the cushion characteristics of the foam layer is reduced and therefore, the effect of the foam layer is not obtained. When the amount is too more, the hollow ratio of the foamed layer becomes so large that the mechanical strength of the foam layer is reduced and the foam layer cannot stand to usual handling. Also, the surface of the foam layer loses smoothness, producing an adverse effect on the outward appearance and image quality. Also, the thickness of the whole foam layer is preferably 30 to 100 μm. When the thickness is too thin, the foam layer has insufficient cushion characteristics and insulation, whereas when the thickness is too thick, the effect of the foam layer is not improved, bringing about reduced strength. Also, as to the particle diameter (size) of the foaming agent, the volume average particle diameter of the foaming agent before foaming is about 5 to 15 μm and the volume average particle diameter of the foaming agent after foaming is 20 to 50 μm. Foaming agents that are too small in volume average particle diameter before and after foaming have a low cushion effect. Foaming agents that are too large in volume average particle diameter before and after foaming each make the surface of the foam layer irregular, and eventually have an adverse influence on the quality of the formed image in some cases.

It is particularly preferable to use, among the above foaming agents, a low-temperature foaming type microsphere in which the softening point of the capsule wall and foaming start temperature are respectively 100° C. or less, and which has an optimum foaming temperature (temperature at which the expansion ratio is highest when a heating time is one minute) of 140° C. or less, and to make the heating temperature as low as possible when the foaming agent is foamed. The use of a microsphere having a lower foaming temperature makes it possible to prevent thermal wrinkles and curling of the support. This microsphere having a low foaming temperature can be obtained by controlling the amount of a thermoplastic resin such as polyvinylidene chloride and polyacrilonitrile which forms the capsule wall. The volume average particle diameter (size) is preferably 5 to 15 μm. The foam layer formed using this microsphere has the advantages that air cells obtained by foaming are closed cells, the foam layer is foamed using a simple process using only heating and the thickness of the foam layer can be easily controlled by the amount of the microsphere to be compounded.

However, this microsphere is not resistant to an organic solvent. When a coating solution containing an organic solvent is used for the foam layer, the capsule wall of the microsphere is eroded, resulting in low foaming characteristics. Therefore, when a microsphere like the above is used, it is desirable to use an aqueous type coating solution that does not contain any organic solvent, for example, ketones such as acetone and methyl ethyl ketone, esters such as ethyl acetate and lower alcohols such as methanol and ethanol which erode the capsule wall. Accordingly, it is desirable to use an aqueous type coating solution, specifically, a solution using a water-soluble or water-dispersible resin or a resin emulsion and preferably an acrylstyrene emulsion or modified vinyl acetate emulsion. Also, even if an aqueous type coating solution is used to form a foam layer, a coating solution formulated with a high-boiling point and highly polar solvent such as NMP, DMF or cellosolve as a cosolvent, a filmforming auxiliary, or a plasticizer has an adverse influence on the microsphere. It is therefore necessary to take it into account, for example, to seize the composition of the aqueous resin to be used and the amount of the high-boiling point solvent to be added, to thereby confirm whether the microcapsule is adversely affected or not.

In the image-receiving sheet of the present invention, the intermediate layer, such as the heat insulating layer, contains hollow polymer particles.

Herein, the hollow polymer particles are polymer particles having independent pores inside of the particles. Examples of the hollow polymer particles include (1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

These hollow polymer particles preferably have a hollow ratio of about 20 to 70%, and may be used in combinations of two or more. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461DE, 551DE and 551DE20 manufactured by Nippon Ferrite (all of these product names are trade names). The hollow polymer particles for use in the heat insulating layer may be a latex thereof.

A water-dispersible resin or water-soluble type resin is preferably contained, as a binder, in the heat insulating layer containing the hollow polymer particles. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. Also, these resins may be used either singly or as mixtures. In the present invention, gelatin is particularly preferable.

The solid content of the hollow polymer particles in the heat insulating layer preferably falls in a range from 5 to 2,000 parts by mass, when the solid content of the binder resin is taken as 100 parts by mass. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, posing problems, for example, powder fall or film separation.

The particle size of the hollow polymer particles is preferably 0.1 to 20 μm, more preferably 0.1 to 2 μm and particularly preferably 0.1 to 1 μm. Also, the glass transition temperature (Tg) of the hollow polymer particles is preferably 70° C. or more and more preferably 100° C. or more.

The heat insulating layer of the heat-sensitive transfer image-receiving sheet of the present invention is free of any resins having poor resistance to an organic solvent, except for the hollow polymer particles. Incorporation of the resin having poor resistance to an organic solvent (resin having a dye-dyeing affinity) in the heat insulating layer is not preferable in view of increase in loss of image definition after image transfer. It is assumed that the color-edge definition loss increases by the reason that owing to the presence of both the resin having a dye-dyeing affinity and the hollow polymer particles in the heat insulating layer, a transferred dye that has dyed the receptor layer migrates through the heat insulating layer adjacent thereto at the lapse of time.

Herein, the term "poor resistance to an organic solvent" means that a solubility in an organic solvent (e.g., methyl ethyl ketone, ethyl acetate, benzene, toluene, xylene) is 1 mass % or more, preferably 0.5 mass % or more. For example, the above-mentioned polymer latex is included in the category of the resin having "poor resistance to an organic solvent".

<Water-Soluble Polymer>

The intermediate layer, such as the heat insulating layer, preferably contains a water-soluble polymer. Herein, the water-soluble polymer means a polymer which dissolves, in 100 g water at 20° C., in an amount of preferably 0.05 g or more, more preferably 0.1 g or more, further preferably 0.5 g or more, and particularly preferably 1 g or more. The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention.

Among the water-soluble polymers which can be used in the present invention, the natural polymers and the semi-synthetic polymers will be explained in detail. Specific examples include the following polymers: plant type polysaccharides such as gum arabics, K-carrageenans, t-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by DAICEL CHEMICAL INDUSTRIES, LTD.), hydroxyethylcelluloses (e.g. HEC, manufactured by DAICEL CHEMICAL INDUSTRIES, LTD.), hydroxypropylcelluloses (e.g. Klucel, manufactured by Aqualon), methylcelluloses (e.g. Viscontran, manufactured by Henkel), nitrocelluloses (e.g. Isopropyl Wet manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Gelatin is one of preferable embodiments in the present invention. Gelatin having a molecular weight of from 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$ and $Zn^{2+}$. Gelatin is preferably added as a water solution.

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Preferred water-soluble synthetic polymers that can be used in the present invention are polyvinyl alcohols.

The polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated surface quality can be improved by an addition of boric acid. The amount of boric acid added is preferably 0.01 to 40 mass % with respect to polyvinyl alcohol.

Preferred binders are transparent or semitransparent, generally colorless, and water-soluble. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides.

In the present invention, the water-soluble polymer preferably comprises polyvinyl alcohols or gelatin, most preferably gelatin.

An amount of the water-soluble polymer to be added in the heat insulating layer is preferably from 1 to 75 mass %, more preferably from 1 to 50 mass % to the entire heat insulating layer.

The heat insulating layer preferably contains a gelatin. The amount of the gelatin in the coating solution for the heat insulating layer is preferably 0.5 to 14% by mass, and particularly preferably 1 to 6% by mass. Also, the coating amount of the above hollow polymer particles in the heat insulating layer is preferably 1 to 100 g/m$^2$, and more preferably 5 to 20 g/m$^2$.

<Crosslinking Agent>

It is preferable that the above-mentioned water-soluble polymer contained in the heat insulation layer is partly or entirely crosslinked with a crosslinking agent.

The crosslinking agent is required to have a plurality of groups capable of reacting with an amino group, a carboxyl group, a hydroxyl group or the like, but the agent to be used may be suitably selected depending on the kind of the water-soluble polymer. Thus, there is no particular limitation for the kind of the crosslinking agent. It is suitable to use each of methods described in T. H. James; "THE THEORY OF THE PHOTOGRAPHIC PROCESS FOURTH EDITION", published by Macmillan Publishing Co., Inc. (1977), pp. 77 to 87, and crosslinking agents described in, for example, U.S. Pat. No. 4,678,739, col. 41; JP-A-59-116655, JP-A-62-245261, and JP-A-61-18942. Both crosslinking agents of an inorganic compound (e.g., chrome alum, boric acid and salts thereof) and crosslinking agents of an organic compound may be preferably used. Alternatively, the crosslinking agent to be used may be a mixture solution containing a chelating agent and a zirconium compound, whose pH is in the range of 1 to 7, as described in JP-A-2003-231775.

Specific examples of the crosslinking agent include epoxy compounds (e.g., diglycidyl ethyl ether, ethyleneglycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds described in JP-A-6-329877, JP-A-7-309954 and the like, and DIC FINE EM-60 (trade name, manufactured by DAINIPPON INK AND CHEMICALS, INCORPORATED)), aldehyde compounds (e.g., formaldehyde, glyoxal, gluralaldehyde), active halogen compounds (e.g., 2,4-dichloro-4-hydroxy-1,3,5-s-triazine, and compounds described in U.S. Pat. No. 3,325,287 and the like), active vinyl compounds (e.g., 1,3,5-trisacryloyl-hexahydro-s-triazine, bisvinylsulfonylmethyl ether, N,N'-ethylene-bis(vinylsulfonylacetamido) ethane, and compounds described in JP-B-53-41220 ("JP-B" means examined Japanese patent publication), JP-B-53-57257, JP-B-59-162546, JP-B-60-80846 and the like), mucohalogen acid compounds (e.g., mucochloric acid), N-carbamoylpyridinium salt compounds (e.g., (1-morpholinocarbonyl-3-pyridinio)methanesulfonate), haloamidinium salt compounds (e.g., 1-(1-chloro-1-pyridinomethylene)pyrrolidinium, 2-naphthalenesulfonate), N-methylol compounds (e.g., dimethylolurea, methyloldimethylhydantoin), carbodiimido compounds (e.g., polycarbodiimido compounds derived from isoholondiisocyanate as described in JP-A-59-187029 and JP-B-5-27450, carbodiimido compounds derived from tetramethylxylylene diisocyanate as described in JP-A-7-330849, multi-branch type carbodiimido compounds described in JP-A-10-30024, carbodiimido compounds derived from dicyclohexylmethane diisocyanate as described in JP-A-2000-7642, and CARBODILITE V-02, V-02-L2, V-04, V-06, E-01 and E-02 (trade names, manufactured by Nisshinbo Industries, Inc.)), oxazoline compounds (e.g., oxazoline compounds described in JP-A-2001-215653 and EPOCROS K-1010E, K-1020E, K-1030E, K-2010E, K-2020E, K-2030E, WS-500 and WS-700 (trade names, manufactured by NIPPON SHOKUBAI CO., LTD.)), isocyanate compounds (e.g., dispersible isocyanate compounds described in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, and Duranate WB40-100, WB40-80D, WT20-100 and WT30-100 (trade names, manufactured by Asahi Kasei Corporation), CR-60N (trade name, manufactured by DAINIPPON INK AND CHEMICALS, INCORPORATED)), polymer (high molecular) hardeners (e.g., compounds described in JP-A-62-234157 and the like); boric acid and salts thereof, borax, and alum.

Preferable compounds as the crosslinking agent include epoxy compounds, aldehyde compounds, active halogen compounds, active vinyl compounds, N-carbamoylpyridinium salt compounds, N-methylol compounds (e.g., dimethylolurea, methyloldimethylhydantoin), carbodiimido compounds, oxazoline compounds, isocyanate compounds, polymer hardeners (e.g., compounds described in JP-A-62-234157 and the like), boric acid and salts thereof, borax, and alum. More preferable crosslinking agent include epoxy compounds, active halogen compounds, active vinyl compounds, N-carbamoylpyridinium salt compounds, N-methylol compounds (e.g., dimethylolurea, methyloldimethylhydantoin), polymer hardeners (e.g., compounds described in JP-A-62-234157 and the like) and boric acid.

The above-mentioned crosslinking agent may be used singly or in combination of two or more.

The crosslinking agent that can be used in the present invention may be added to the water-soluble polymer solution in advance, or may be added at the last step for the preparation of the coating solution. Alternatively, the crosslinking agent may be added just before the coating.

The addition amount of the crosslinking agent that can be used in the present invention varies depending on the kinds of the water-soluble binder and the crosslinking agent, but it is preferable that the amount is approximately in the range of from 0.1 to 50 mass parts, more preferably from 0.5 to 20 mass parts, and further more preferably from 1 to 10 mass parts, based on 100 mass parts of the water-soluble polymer contained in the constituting layer.

The water-soluble polymer in the heat insulation layer is preferably cross-linked in a ratio of from 0.1 to 20 mass %, more preferably from 1 to 10 mass %, among the entire water-soluble polymer, even though the ratio varies depending on the kind of the crosslinking agent.

A thickness of the heat insulating layer containing the hollow polymer particles is preferably from 5 to 50 μm, more preferably from 5 to 40 μm.

<Support>

Coated paper and polyethylene-coated paper (such as WP paper or both-sides laminated paper) can be used as a support. The present invention prefers polyethylene-coated paper in particular. The polyethylene-coated paper is preferably both-sided polyethylene laminated paper whose base has a uniform fiber distribution, and besides, which is mixed with a reflective pigment ($TiO_2$) or dye in the layer on the image-forming side. At the time of extrusion lamination, it is preferable to perform surface treatment, such as calendering or mat treatment, and further perform anti-curl backing in order to balance the back side with the front side. Specifically, supports used in silver halide color photographic materials are suitable.

(Coated Paper)

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862. Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

(Polyethylene-Coated Paper)

Laminated paper usable as a support is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μM, more preferably from 50 μM to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

Also, the heat-sensitive transfer image-receiving sheet may be used in various applications enabling heat-sensitive transfer recording, such as heat-sensitive transfer image-receiving sheets in a form of thin sheets (cut sheets) or rolls; cards; and transmission type manuscript-making sheets, by optionally selecting the type of support.

According to the present invention, it is possible to provide a heat-sensitive transfer image-receiving sheet which gives a high transfer density, reduced image defects, and especially no defect of transferred dye.

The present invention will be described in more detail based on the following examples, but the invention is not intended to be limited thereto.

EXAMPLES

In the following Examples, the terms "part" and "%" are values by mass, unless they are indicated differently in particular.

Reference Example

Preparation of Heat-Sensitive Transfer Sheets

A polyester film 6.0 μm in thickness (trade name: Lumirror, manufactured by Toray Industries, Inc.), the back side of which had been subjected to a heat-resisting and sliding treatment with a thermosetting acryl resin (thickness: 1 μm), was used as the support. To the surface of the above-described polyester film, a heat-sensitive transfer layer-coating solution was applied by a wire bar coating so that the coating amount after dry could become 1 g/m$^2$, thereby to prepare a heat-sensitive transfer sheet having a heat-sensitive transfer layer on the support.

<Coating solution for heat-sensitive transfer layer>

| Yellow composition | |
|---|---|
| Dye (Y) - 1 | 2.3 parts by mass |
| Dye (Y) - 2 | 2.2 parts by mass |
| Polyvinylbutyral resin (Trade name: S-LEC BX-1, manufactured by Sekisui Chemical Co., Ltd.) | 4.5 parts by mass |
| Methyl ethyl ketone/toluene (1/1, at mass ratio) | 90 parts by mass |
| **Magenta composition** | |
| Dye (M) - 1 | 2.3 parts by mass |
| Dye (M) - 2 | 1.1 parts by mass |
| Dye (M) - 3 | 1.1 parts by mass |
| Polyvinylbutyral resin (Trade name: S-LEC BX-1, manufactured by Sekisui Chemical Co., Ltd.) | 4.5 parts by mass |
| Methyl ethyl ketone/toluene (1/1, at mass ratio) | 90 parts by mass |

-continued

<Coating solution for heat-sensitive transfer layer>

| Cyan composition | |
|---|---|
| Dye (C) - 1 | 2.3 parts by mass |
| Dye (C) - 2 | 2.2 parts by mass |
| Polyvinylbutyral resin (Trade name: S-LEC BX-1, manufactured by Sekisui Chemical Co., Ltd.) | 4.5 parts by mass |
| Methyl ethyl ketone/toluene (1/1, at mass ratio) | 90 parts by mass |

(Y)-1

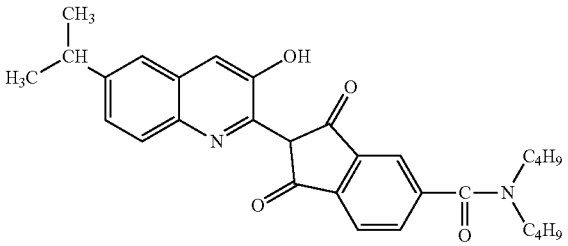

(Y)-2

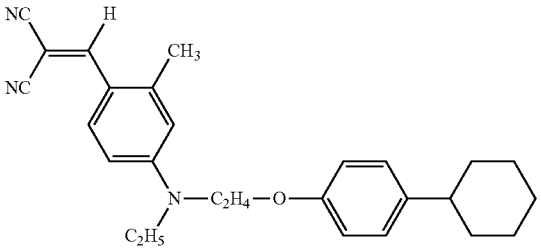

(M)-1

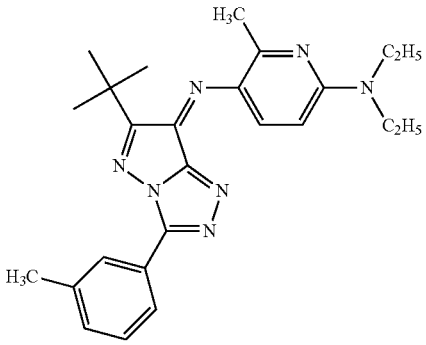

(M)-2

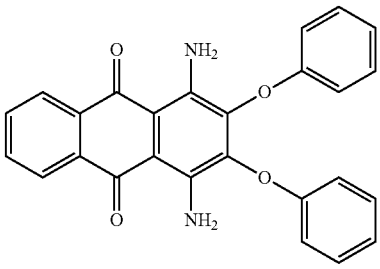

-continued (M)-3

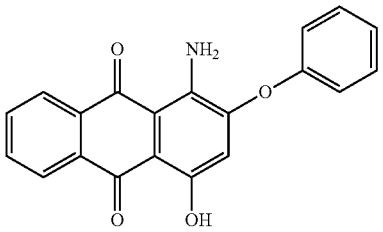

(C)-1

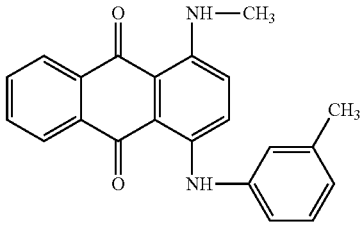

(C)-2

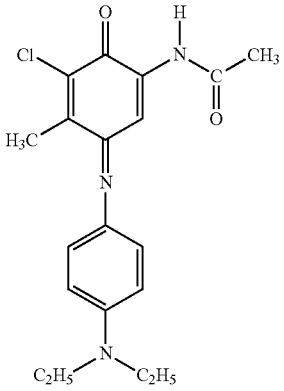

(Preparation of a Heat-Sensitive Transfer Image-Receiving Sheet 101 (this Invention))

(Preparation of Support A)

A pulp slurry was prepared from 50 parts by mass of hardwood kraft pulp (LBKP) of acacia origin and 50 parts by mass of hardwood kraft pulp (LBKP) of aspen origin, by beating these pulps by means of a disk refiner until Canadian standard freeness reached to 300 ml.

To the pulp slurry thus prepared were added, on a pulp basis, 1.3 mass % of modified cationic starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZEPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The resulting pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, then, dried and further subjected to calendering treatment. Therein, the papermaking was performed so that the raw paper had a grammage (basis weight) of 157 g/m$^2$, and the raw paper (base paper) having a thickness of 160 μm was obtained.

The wire side (back side) of the base paper obtained was subjected to corona discharge treatment, and thereto a resin composition, in which a high-density polyethylene having an MFR (which stands for a melt flow rate, and hereinafter has the same meaning) of 16.0 g/10 min and a density of 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene having an MFR of 4.0 g/10 min and a density of 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side".) The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating had a dry mass of 0.2 g/m$^2$. Subsequently, the front surface (front side) of the base paper was subjected to corona discharge treatment, and then coated with 27 g/m$^2$ of a low-density polyethylene having an MFR of 4.0 g/10 min and a density of 0.93 g/m$^3$ and containing 10 mass % of titanium oxide, by means of a melt extruder, thereby forming a thermoplastic resin layer with a specular surface, to provide Support A.

On the support A prepared as described above, there were applied a coating solution for an interlayer having the composition set fort below and a coating solution for a receptor layer 1 having the composition set fort below in an order from a lower layer, so that the thickness of each of the interlayer and the receptor layer after drying would become 15 μm and 4 μm, respectively. The polymer used in the interlayer and the coating method are described in Table 1 below.

| <Coating solution for interlayer 1> | |
|---|---|
| Hollow polymer latex (MH5055, manufactured by Nippon Zeon) (water dispersion of hollow-structure polymer particles having an outside diameter of 0.5 μm) | 150 mass parts |
| 10% Gelatin aqueous solution | 100 mass parts |
| Sodium salt of 2,4-dichloro-6-hydroxy-1,3,5-triazine | 2 mass parts |
| NaOH | Amount necessary to make pH 7.5 |
| <Coating solution for receptor layer 1> | |
| Vinyl chloride/vinyl acetate resin (Trade name: Solbin A, manufactured by Nissin Chemical Industry Co., Ltd.) | 100 parts by mass |
| Polyester resin (Trade name: Vylon 200, manufactured by Toyobo Co., Ltd.) | 70 parts by mass |
| Amino-modified silicone (Trade name: X22-3050C, manufactured by Shin-Etsu Chemical Co., Ltd.) | 5 parts by mass |
| Epoxy-modified silicone (Trade name: X22-300E, manufactured by Shin-Etsu Chemical Co., Ltd.) | 5 parts by mass |
| Methyl ethyl ketone/toluene | 400 parts by mass |

(Preparation of Heat-Sensitive Transfer Image-Receiving Sheet 102)

A heat-sensitive transfer image-receiving sheet 102 was prepared in the same manner as that of the heat-sensitive transfer image-receiving sheet 101, except that the coating solution for interlayer 1 was changed as described below.

| <Coating solution for interlayer 2> | |
|---|---|
| Hollow polymer latex (MH5055, manufactured by Nippon Zeon) (water dispersion of hollow-structure polymer particles having an outside diameter of 0.5 μn) | 150 mass parts |
| 10% Polyvinyl alcohol (Trade name: PVA-105, manufactured by Kuraray Co., Ltd.) | 100 mass parts |
| Sodium salt of 2,4-dichloro-6-hydroxy-1,3,5-triazine | 2 mass parts |
| NaOH | Amount necessary to make pH 7.5 |

(Preparation of Heat-Scnsilivc Transfer Image-Receiving Sheet 103)

A heat-sensitive transfer image-receiving sheel 103 was prepared in the same manner as that of the heat-sensitive transfer image-receiving sheet 101, except that the coating solution for receptor layer 1 was changed as described below.

| <Coating solution for receptor layer 2> | |
|---|---|
| Vinyl chloride/vinyl acetate resin (Trade name: Solbin CL, manufactured by Nissin Chemical Industry Co., Ltd.) | 100 parts by mass |
| Polyester resin (Trade name: Vylon 200, manufactured by Toyobo Co., Ltd.) | 70 parts by mass |
| Amino-modified silicone (Trade name: X22-3050C, manufactured by Shin-Etsu Chemical Co., Ltd.) | 5 parts by mass |
| Epoxy-modified silicone (Trade name: X22-300E, manufactured by Shin-Etsu Chemical Co., Ltd.) | 5 parts by mass |
| Methyl ethyl ketone/toluene (=1/1, at mass ratio) | 400 mass parts |

(Preparation of Heat-Sensitive Transfer Image-Receiving Sheet 104)

As a support B, there was used a synthetic paper (trade name: yupo FPG200, thickness 200 μM, manufactured by yupo corporation). On one side of the support, a coating solution for white interlayer having the composition set forth below was coated with a bar coater, and then the above-described coating solution for a receptor layer 1 was coated on the thus-formed white interlayer. The coating was performed so that coating amounts after dry of the white interlayer and the receptor layer would be 1.0 g/m$^2$ and 4.0 g/m$^2$, respectively. Drying of each layer was conducted at 110° C. for 30 seconds.

| <Coating solution for white interlayer> | |
|---|---|
| Polyester resin (Trade name: Vylon 200, manufactured by Toyobo Co., Ltd.) | 50 mass parts |
| Fluorescent whitening agent (Trade name: Uvitex OB, manufactured by Ciba Specialty Chemicals) | 1 mass part |
| Titanium oxide | 30 mass parts |
| Methyl ethyl ketone/toluene (=1/1, at mass ratio) | 90 mass parts |

(Preparation of Heat-Sensitive Transfer Image-Receiving Sheet 105)

A heat-sensitive transfer image-receiving sheet 105 was prepared in the same manner as that of the heat-sensitive transfer image-receiving sheet 103, except that the coating solution for interlayer 1 was changed as described below.

| <Coating solution for receptor layer 3> | |
|---|---|
| Fluorine surface active agent (Trade name: Fluorad FC-170C, manufactured by 3M Corporation) | 1 mass part |
| Polyvinyl alcohol | 150 mass parts |
| Distilled water | 1,000 mass parts |

(Image Formation)

The heat-sensitive transfer sheets as reference examples and the image-receiving sheets 101 to 105 were worked to be made loadable in a sublimation printer, DPB1500 (trade name, manufactured by Nidec Copal Corporation), and image outputs were produced. As the output images, output images of the gradation of gray were produced at the settings for attaining the maximum densities in the case of the maximum transfer density.

(Evaluation of Defects of Transferred Dye)

Defects of transferred dye detectable by visual inspection were evaluated on images of the gradation of gray produced at the foregoing settings. The defects of transferred dye were rated by counting the number of defects 0.5 mm or greater in size per one sheet of picture measuring 12 cm by 10 cm.

Excellent (○): less than 2 per area measuring 12 cm by 10 cm

Fair (Δ): from 2 to less than 10 per area measuring 12 cm by 10 cm

Poor (x): 10 or above per area measuring 12 cm by 10 cm

TABLE 1

| Heat-sensitive transfer image-receiving sheet | 101 (This invention) | 102 (This invention) | 103 (This invention) | 104 (Comparative example) | 105 (Comparative example) |
|---|---|---|---|---|---|
| Receptor layer | Vinyl chloride/vinyl acetate resin | Vinyl chloride/vinyl acetate resin | Vinyl chloride/vinyl acetate resin | Vinyl chloride/vinyl acetate resin | Polyvinyl alcohol polymer |
| Interlayer | Hollow polymer particles were contained/Gelatin was contained. | Hollow polymer particles were contained/Polyvinyl alcohol was contained. | Hollow polymer particles were contained/Gelatin was contained. | Polyester resin was contained. | Hollow polymer particles were contained/Gelatin was contained. |
| Support | A (Polyethylene-coated Paper) | A (Polyethylene-coated Paper) | A (Polyethylene-coated Paper) | B (Synthetic paper) | A (Polyethylene-coated Paper) |
| Defects of the transfer | ○ | Δ | ○ | x | x |

As can be seen from the above, transferred images reduced in defects of transfer dye were obtained in the heat-sensitive transfer image-receiving sheets each having on the support a receptor layer containing at least one polymer selected from vinyl chloride polymers. Of these heat-sensitive transfer image-receiving sheets, those using gelatin as the water-soluble polymer in their individual intermediate layers, notably those further using polyethylene-coated paper as their supports, provided images reduced significantly in defects of transfer dye.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer image-receiving sheet, comprising, on a support, a receptor layer containing at least one polymer selected from the group consisting of vinyl chloride polymers, and a heat insulation layer containing hollow polymer particles and a gelatin as a binder resin between the support and the receptor layer;

wherein the particle size of the hollow polymer particles is 0.1 to 2 μm, wherein the hollow polymer particles are non-foaming type hollow particles each having a capsule wall formed of at least one selected from the group consisting of a polystyrene, acryl resin, or styrene/acryl resin, and prepared by drying water inside of the capsule wall so as to make the inside of each particle hollow;

wherein the support is a laminated paper wherein the both sides of a base paper are laminated with a polyethylene;

wherein the polyethylene at the receptor layer side contains titanium oxide and a charge control layer is formed on the polyethylene at the side opposite to the receptor layer side of the base paper.

2. The heat-sensitive transfer image-receiving sheet according to claim 1, wherein the at least one polymer is a vinyl chloride-vinyl acetate copolymer.

3. The heat-sensitive transfer image-receiving sheet according to claim 1, wherein the ratio of vinyl chloride in the at least one polymer is 50 mass % or more.

4. The heat-sensitive transfer image-receiving sheet according to claim 1, wherein the binder resin in the heat insulation layer consists of a water-soluble polymer.

5. The heat-sensitive transfer image-receiving sheet according to claim 1, wherein the binder resin in the heat insulation layer consists of a gelatin.

6. The heat-sensitive transfer image-receiving sheet according to claim 1, wherein the heat insulation layer is a single layer.

7. The heat-sensitive transfer image-receiving sheet according to claim 1, wherein the heat insulation layer is a single layer and provided in contact with the receptor layer.

8. The heat-sensitive transfer image-receiving sheet according to claim 1, wherein the polyethylene at the side opposite to the receptor layer side of the support is a blend of a low-density polyethylene and a high-density polyethylene.

9. The heat-sensitive transfer image-receiving sheet according to claim 1, wherein the receptor layer contains at least two releasing agents.

10. The heat-sensitive transfer image-receiving sheet according to claim 1, wherein the receptor layer further contains a polyester.

* * * * *